United States Patent [19]

Talve

[11] 4,382,417

[45] May 10, 1983

[54] GLIDER SAIL ASSEMBLY

[76] Inventor: Harri Talve, 8271 Heather St., Richmond, British Columbia, Canada, V6Y 2R3

[21] Appl. No.: 227,172

[22] Filed: Jan. 22, 1981

[51] Int. Cl.[3] ..... B63H 9/04

[52] U.S. Cl. ..... 114/102; 114/39; 114/90

[58] Field of Search ..... 114/39, 102, 103, 90, 114/91; 903/374; 244/DIG. 1, 153 R

[56] References Cited

U.S. PATENT DOCUMENTS

| | | | |
|---|---|---|---|
| 2,126,665 | 8/1938 | Rowland | 114/102 |
| 2,170,914 | 8/1939 | Rummler | 114/39 |
| 2,643,628 | 6/1953 | Sveinsson | 114/91 |
| 3,135,482 | 6/1964 | Girard | 244/DIG. 1 |
| 3,359,919 | 12/1967 | Stewart | 244/DIG. 1 |
| 3,370,560 | 2/1968 | Lucht | 114/102 |
| 3,707,935 | 1/1973 | Rachie | 114/102 |
| 3,902,443 | 9/1975 | McDougall | 114/39 |
| 4,044,702 | 8/1977 | Jamieson | 114/102 |
| 4,276,033 | 6/1981 | Krovina | 114/103 |

FOREIGN PATENT DOCUMENTS

| | | | |
|---|---|---|---|
| 94817 | 4/1923 | Austria | 114/39 |
| 508218 | 9/1930 | Fed. Rep. of Germany | 114/39 |
| 1184914 | 3/1970 | United Kingdom | 114/102 |

OTHER PUBLICATIONS

Popular Science, Jul. 1963, p. 91.

*Primary Examiner*—Trygve M. Blix
*Assistant Examiner*—Thomas J. Brahan
*Attorney, Agent, or Firm*—Carver & Co.

[57] ABSTRACT

A glider sail assembly comprises a center boom with a fore end for directing into a wind and a mount for connecting the center boom generally horizontally at the top of a mast and directed at an upward angle towards the fore end. Each of two side booms has a fore end connected to the center boom near the fore end of the center boom and flexible portions near an aft end of said each side boom. The side booms are extendable to diverge away from each other in a V-shaped arrangement. A generally triangular sail is securable to the booms, so the sail extends between the side booms, and has skirt portions at each side thereof adjacent the flexible portions of the side booms. The skirt portions extend downwardly when the flexible portions of the side booms are deflected downwardly, so one of the skirt portions provides a propulsive force when the center boom is directed into the wind.

14 Claims, 26 Drawing Figures

WIND
10
12
16
1
2
92

GLIDER SAIL ASSEMBLY

BACKGROUND OF THE INVENTION

The invention relates to a glider sail assembly for mounting generally horizontally at the top of a mast on a vessel or vehicle.

Marine vessels of the general type having a glider-type sail mounted on the top of a mast have been previously proposed as exemplified, for example, by U.S. Pat. No. 4,068,607 to Harmon. The sail in this patent has lift characteristics to prevent a boat from overturning. Similarly, U.S. Pat. No. 2,126,665 to Rowland shows a boat hull equipped with a sail which is disposed at an angle such that it provides lift as well as a propulsive force. A similar arrangment is shown in U.S. Pat. No. 2,170,914 to Rummler. U.S. Pat. No. 4,077,345 to Gurley shows another glider sail arrangement. U.S. Pat. No. 4,186,680 to Harpole shows a sail assembly which may be used for a small boat and the like.

Other U.S. Pat. Nos. relating to boats provided with glider sails or the like include 3,966,143 to Smith, 3,884,172 to Takahashi, 1,823,096 to Gilbert, 57,996 to Sykes, 758,171 to Collins and 2,329,220 to Rummler.

Despite such prior art devices, it is still considered desirable to produce a glider sail assembly capable of improved performance, maneuverability and stability and which is capable of propelling a small water craft in a skip-glide from wave top to wave top.

SUMMARY OF THE INVENTION

According to the invention, a glider sail assembly comprises a center boom with a fore end for directing into a wind and means for mounting the center boom generally horizontally at the top of a mast and directed at an upward angle towards the fore end. There are two side booms, each of the side booms having a fore end connected to the center boom near the fore end of the center boom and flexible portions near an aft end of said each side boom. The side booms are extendable to diverge away from each other in a V-shaped arrangement. A generally triangular sail is securable to the boom, so the sail extends between the side booms, and has skirt portions at each side thereof adjacent the flexible portions of the side booms. The skirt portions extend downwardly when the flexible portions of the side booms are deflected downwardly, so one of the skirt portions provides a propulsive force when the center boom is directed into the wind.

The means for mounting the center boom may comprise a resilient member which allows lateral tilting of the sail about the center boom. For example, the means for mounting may comprise an outer shell hingedly connectable to the top of the mast and extending about the center boom, the resilient member comprising a tubular insert between the outer shell and the center boom.

The assembly may further comprise the mast, means for rotatably mounting the mast on a vessel or vehicle for axial rotation and means for rotating the vessel or vehicle relative to the mast.

In a preferred form, the assembly further comprises means for folding the mast to a generally horizontal position. For example, the means for folding may comprise fore and aft hinged mast supports, each said support having a lower end with means for hingedly connecting the support to the vessel or vehicle and having an upper end hingedly connected to the mast.

The assembly may further comprise a hoop connected to the assembly near the bottom of the mast, the mast extending upwardly from near the center of the hoop when in an operational position. A rope runner is rotatable about the mast, the hoop comprising a circular track for the rope runner. The rope runner has means for holding rope connected to the sail and moving about the hoop as the vessel or vehicle rotates relative to the mast.

The center boom may be flexible and the assembly may further comprise a first cable for strengthening the assembly, the first cable being connected at each end to one of the side booms and being extendable downwardly in a V-shaped arrangement and slidably received by a guide near the bottom of the mast. Second and third cables extend downwardly from the fore and aft ends of the center boom to be secured together near the bottom of the mast in a V-shaped arrangement. The second and third cables are tensioned to adjust the upward angle of the center boom and to bend the center boom into a bow shape and thereby providing increased lift for the sail. Fourth and fifth cables are connected to the aft ends of the side booms. One of the fourth and fifth cables is tensioned to deflect the flexible portions of one of the side booms downwardly with one of the skirt portions of the sail to provide the propulsive force.

A sail assembly according to the invention offers significant advantages when compared with prior art devices and is suitable for powering smaller water craft as well as land vehicles. The sail assembly is capable of providing sufficient lift to raise the hull of a water craft clear of the water for short flights in a skipping motion from wave top to wave top. The speed of the vessel is considerably enhanced due to the reduction in fluid drag. Additionally, by providing the skirt portions of the sail, the assembly can always be directed into the wind, while the forward skirt is deflected downwardly to stabilize the assembly and provide forward propulsion. The entire assembly, including the mast, is capable of being folded against the upper deck of the vessel when not in use and may be self-erected by utilizing lift created by the wind. The direction of the vessel can be changed simply by applying a torque to the mast so that the hull of the vessel rotates about the mast relative to the sail. Other advantages of the sail assembly are discussed in relation to the preferred embodiment described below.

DESCRIPTION OF THE PREFERRED EMBODIMENTS

Figure 1:
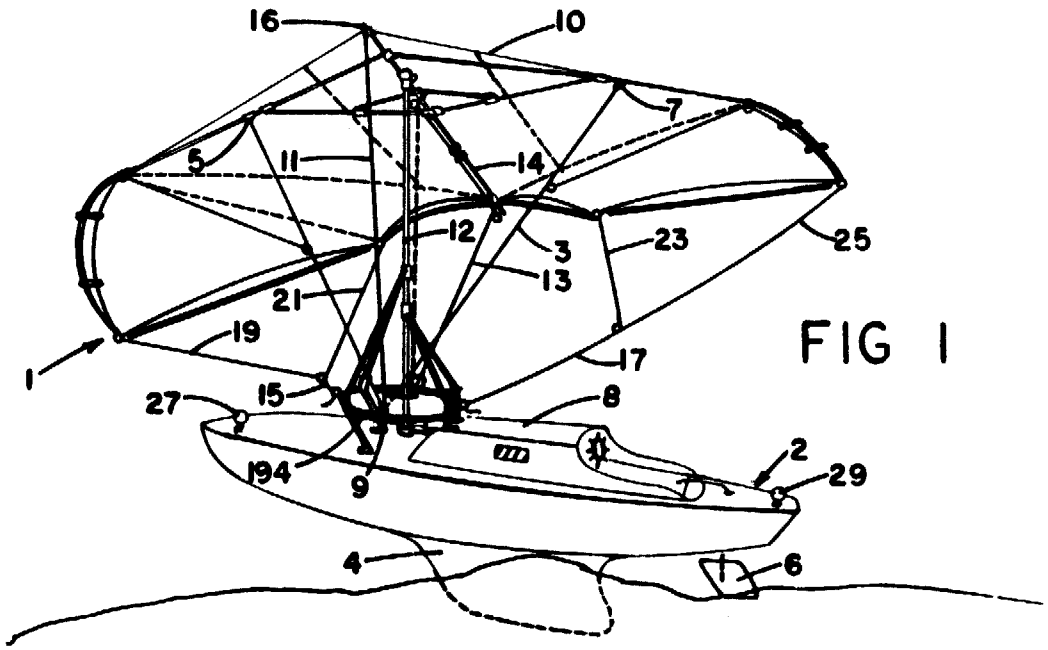
FIG. 1 is a perspective view of a glider sail assembly, according to an embodiment of the invention, fitted to a yacht.

FIG. 1 shows a glider sail assembly 1, according to the invention, mounted on a yacht hull 2. The hull 2 is conventional, including a keel 4, a rudder 6 and a cabin 8, so is not described in more detail.

Figure 2:
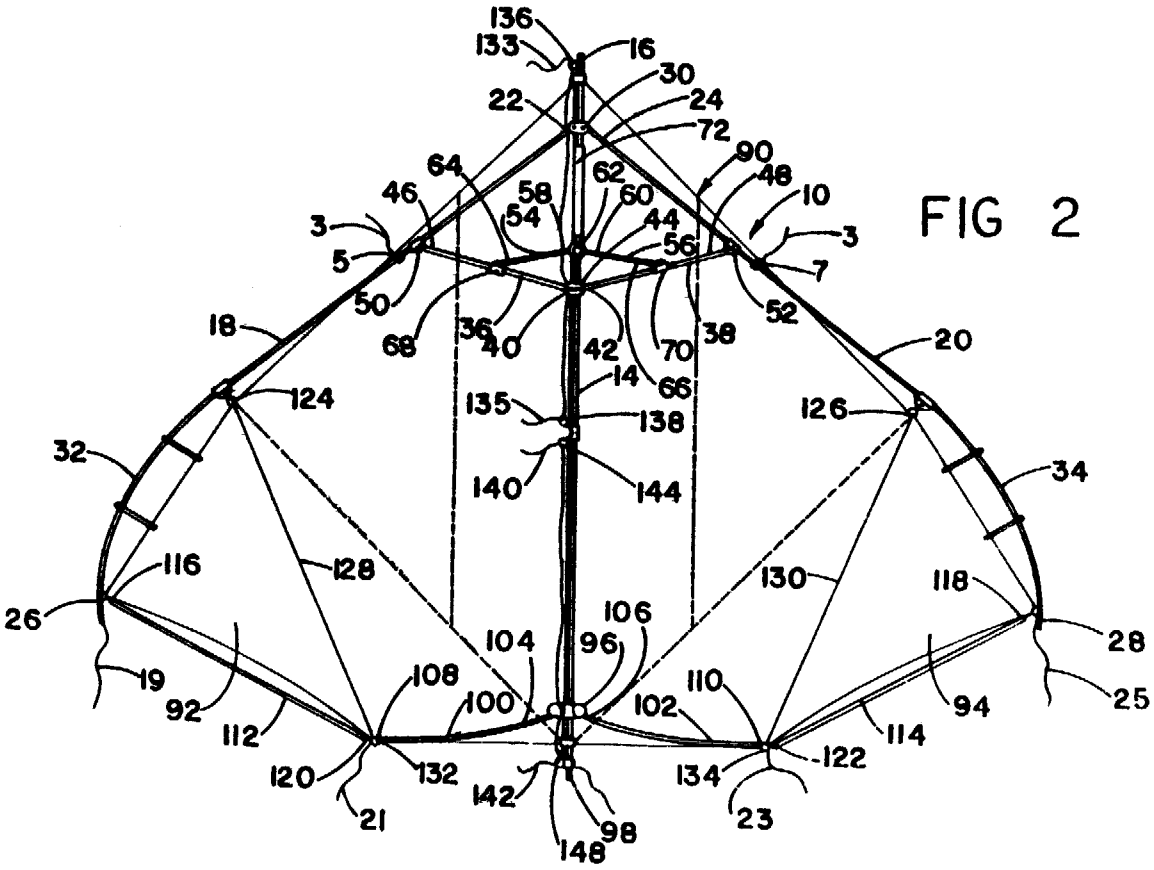
FIG. 2 is a bottom plan view of the boom structure and sail of the sail assembly shown in FIG. 1.
Figure 9:
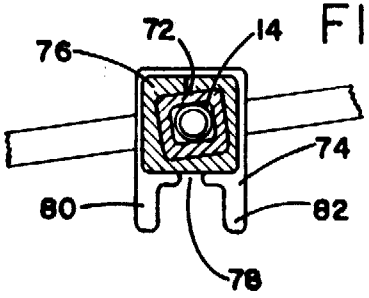
FIG. 9 is a view of a portion of the center boom and the means for mounting the center boom at the top of the mast, showing the center boom laterally tilted.
Figure 8:
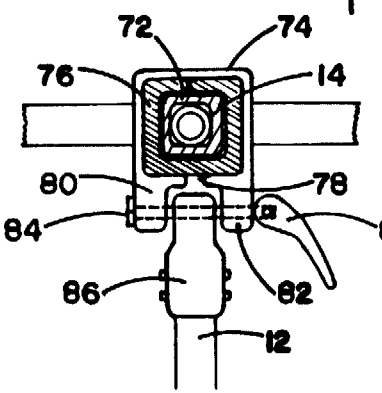
FIG. 8 is an enlarged fragmentary view showing the top of the mast, a portion of the center boom and the means for mounting the center boom at the top of the mast for the embodiment of FIG. 1.

The glider sail assembly includes a boom and sail assembly 10, shown in better detail in FIG. 2, mounted at the top of a mast 12. The boom and sail assembly has a center boom 14 of a suitable material, such as glass fiber reinforced plastic and which is stiff, but somewhat flexible. The center boom is mounted generally horizontally at the top of the mast, but its fore end 16 is directed at an upwards angle in use as seen in FIG. 1. In the preferred embodiment, the center boom is a tube with a circular cross section as seen in FIGS. 8 and 9.

The boom and sail assembly 10 also includes two side booms 18 and 20, having respective fore ends 22 and 24 and respective aft ends 26 and 28. The fore ends of the side booms are hingedly connected to a first slide member 30 which is slidably received on the center boom near its fore end. The hinged connections at the fore ends of the side booms permit lateral pivotting of the side booms to fold and unfold the boom and sail assembly.

While the fore portions of the side booms are relatively rigid, the portions near the aft ends are more flexible and comprise side rods 32 and 34. The flexibility of the side rods is enhanced by a reduction in the cross-sectional extent of the rods when compared with the fore portions of the side masts. As with the center mast, glass fiber reinforced plastic rods are suitable.

As seen in FIG. 2, the side booms are extendable, in the unfolded position, to diverge away from each other in a V-shaped arrangement. The boom and sail assembly includes a pair of struts 36 and 38 which serve as means for holding the side booms outwardly away from the center boom in the V-shaped arrangement. The struts have first ends 40 and 42, respectively, hingedly connected to a second slide member 44 which is slidably received on the center boom 14. Second ends 46 and 48 are hingedly connected to the hinge members 50 and 52 which are fixedly connected to the side booms near the fore ends 22 and 24.

A pair of braces 54 and 56 have first ends 58 and 60, respectively, hingedly connected to a hinged member 62 which is rigidly connected to the center boom between the first slide member 30 and the second slide member 44. The braces have second ends 64 and 66 hingedly connected to the hinge members 68 and 70, respectively, which are fixedly connected to the struts 36 and 38 near the centers thereof.

A section of square tubing 72, between the hinge member 62 and the first slide member 30, serves as reinforcement for the center boom 14 to mount the center boom at the top of the mast. Referring to FIGS. 8 and 9, the means for mounting the center boom at the top of the mast also includes a box-sectioned shell 74 of a suitable material such as glass-fiber reinforced plastic. A square-tubular resilient insert 76, of rubber or a synthetic substitute, is fitted between the shell and the reinforcement 72 on the center boom. The shell 72 has a longitudinal slit 78 below the resilient insert and a pair of lugs 80 and 82 on each side of the slit. A bolt or pin 84, passing through suitable apertures in lugs 80 and 82 and fitting 86 at the top of mast 12 serves to hingedly connect the center boom to the top of the mast. A cam action lever 88 is hingedly connected to the end of bolt 84 and, when pivotted downwardly, provides a clamping action to releasably secure the shell at a fixed axial position along the reinforcement 72, by pressing the lugs 80 and 82 together. When the handle 88 is pivotted upwardly, the lugs spread apart, allowing reinforcement 72 and center boom 14 to be moved axially through the shell. This permits fore and aft adjustment of the boom and sail assembly relative to the position of the mast.

Figures 16, 17, 18, 19, 20, 21, 22, 23, 24, 25, 26:
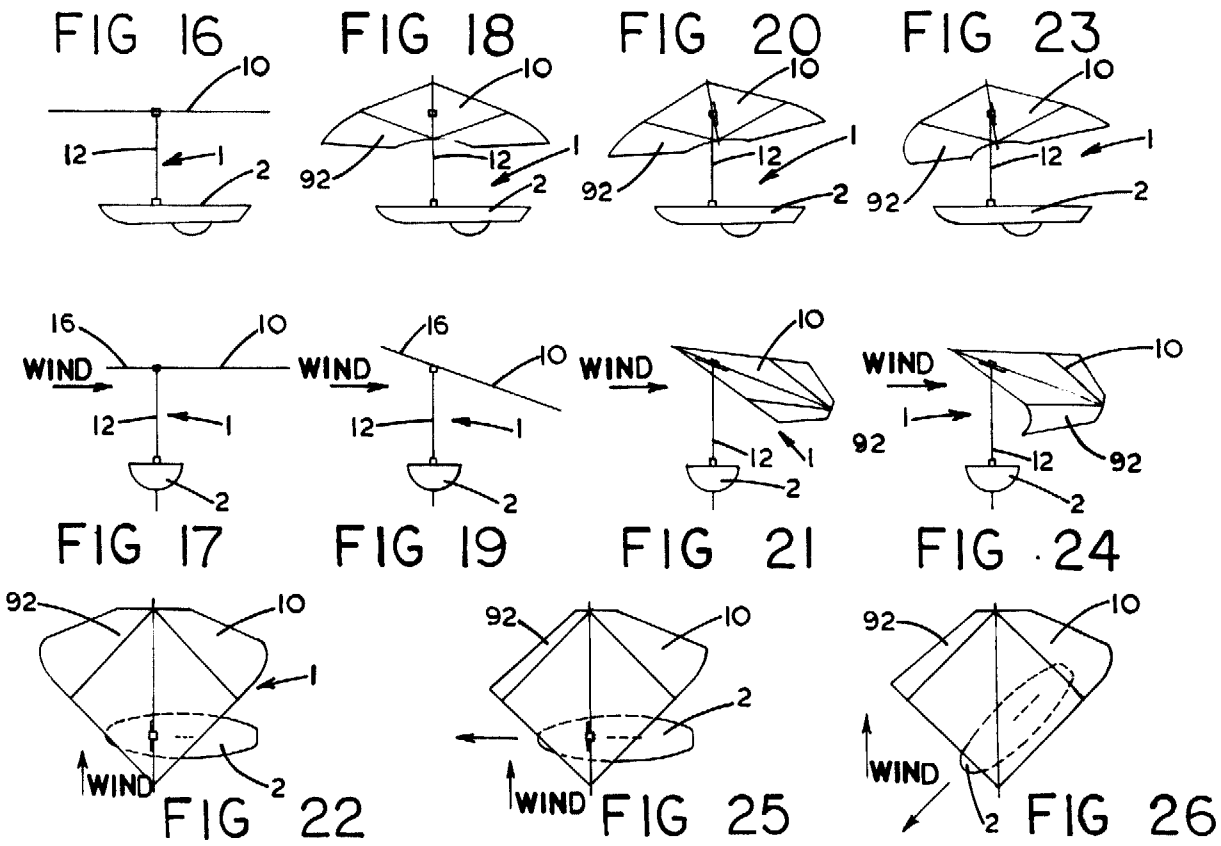
FIGS. 16 and 17 are side elevational and end views, respectively, of the glider sail assembly and yacht of FIG. 1 with the sail erected and in the neutral position.
FIGS. 18 and 19 are side elevational and end views, respectively, of the glider sail assembly and yacht with the sail in the neutral position, but angled upwardly to catch the wind.
FIGS. 20, 21 and 22 are side elevational, end and top plan views, respectively, of the glider sail assembly and yacht with the sail tilted to go forward, but unbalanced.
FIGS. 23, 24 and 25 are side elevational, end and top plan views of the glider sail and yacht with the sail balanced for forward travel.
FIG. 26 is a top plan view similar to FIG. 25, but showing the hull rotated relative to the sail to change the direction of travel.

Referring to FIG. 2, it may be seen that a generally triangular sail 90 of a sheet-like material is secured to the center boom and the side booms. The sail has skirt portions 92 and 94 at each side thereof adjacent the side rods 32 and 34. The skirt portions extend downwardly when the side rods are deflected downwardly. In this manner, one of the skirt portions, for example, the forward skirt portion shown in FIG. 23, provides a propulsive force when the center boom is directed into the wind.

A third slide member 96 is slidably received on the center boom near its aft end 98. A pair of tail rods 100 and 102 extend between the center boom and one of the skirt portions and have their inner ends 104 and 106 hingedly connected to the third slide member. Outer ends 108 and 110 of the tail rods are connected to the sail adjacent the skirt portions. Skirt booms 112 and 114 have their outer ends 116 and 118 connected to the aft ends 26 and 28 of the side booms and have inner ends 120 and 122 which are securable adjacent the outer ends of the tail rods.

The side rods 32 and 34 have eyes 124 and 126 at their forward ends. Cables or ropes 128 and 130 extend between the eyes 124 and 126 and the outer ends of the tail rods. The skirt booms 112 and 114 are provided with eyes 132 and 134 at their inner ends for slidably receiving the cables 128 and 130.

Figure 15:
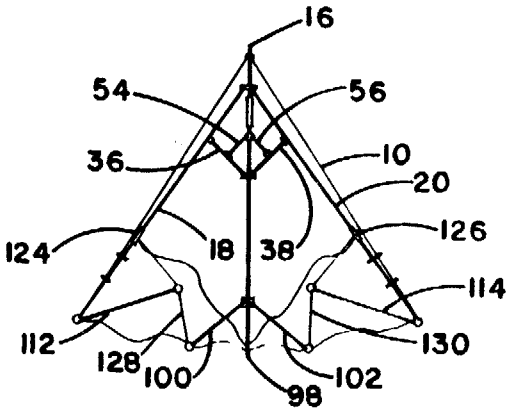
FIG. 15 is a bottom plan view of the boom assembly and sail of FIG. 2, shown partly folded.

A first pair of ropes 133 and 135 are connected to the second slide member 44 and extend over the pulleys 136 and 138 on the center boom. Similarly, a pair of ropes 140 and 142 are connected to the third slide member 96 and extend over pulleys 144 and 148. The sail and boom assembly is maintained in the extended position shown in FIGS. 1 and 2 by maintaining tension on ropes 133 and 142, thus urging slide members 44 and 96 towards the fore and aft ends of the center boom, respectively. The boom and sail assembly is folded by releasing ropes 133 and 142 and by applying tension to ropes 135 and 140. Ropes 135 and 140 are used to move the second slide member towards the aft end of the center boom and to move the slide member 96 towards the fore end of the boom. Slide member 30 thus slides towards the fore end of the center boom and the side booms fold towards the center boom by hinged movements at their forward ends as seen in FIG. 15. The inner ends of the skirt booms 112 and 114 slide along the ropes 128 and 130 toward the eyes 124 and 126. The side booms may be folded until their aft ends 26 and 28 are near the aft end 98 of the center boom. Unfolding of the sail is accomplished by applying tension to ropes 133 and 142.

Figure 3:
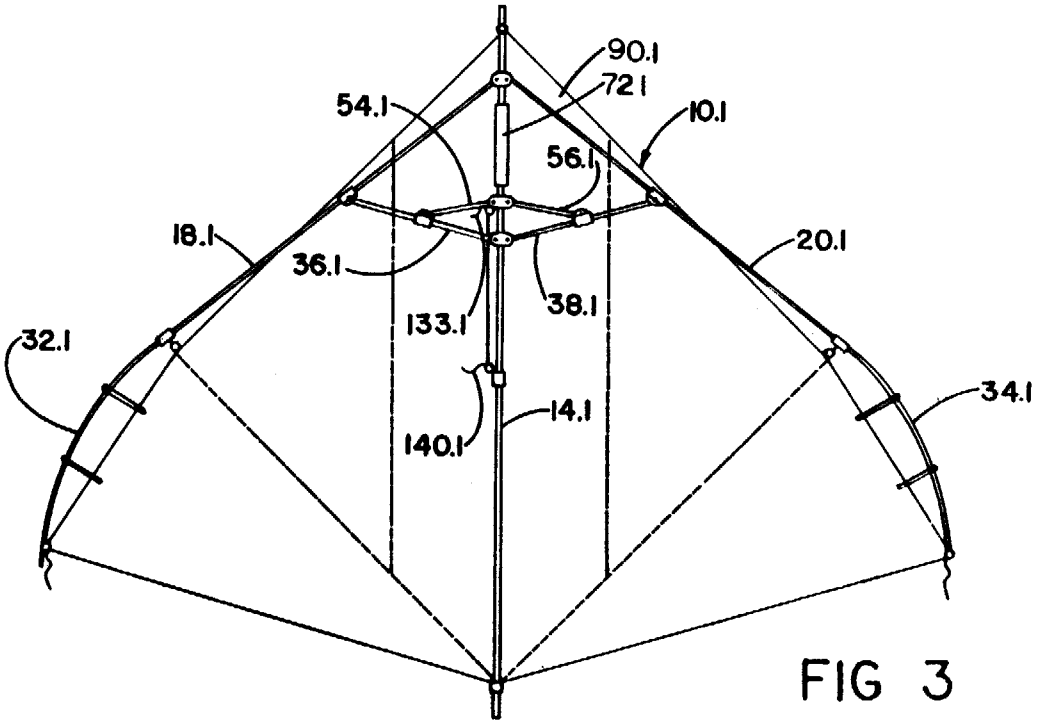
FIG. 3 is a bottom plan view of another boom structure and sail.

FIG. 3 illustrates another boom and sail assembly 10.1 which is similar to the embodiment of FIG. 2. The same numbers are used to designate equivalent parts with the additional designation "0.1". This is a simplified embodiment in which the tail rods and skirt rods have been deleted. The structure is otherwise similar and the folding and unfolding is accomplished by means of rope 133.1 and 140.1.

Figure 4:
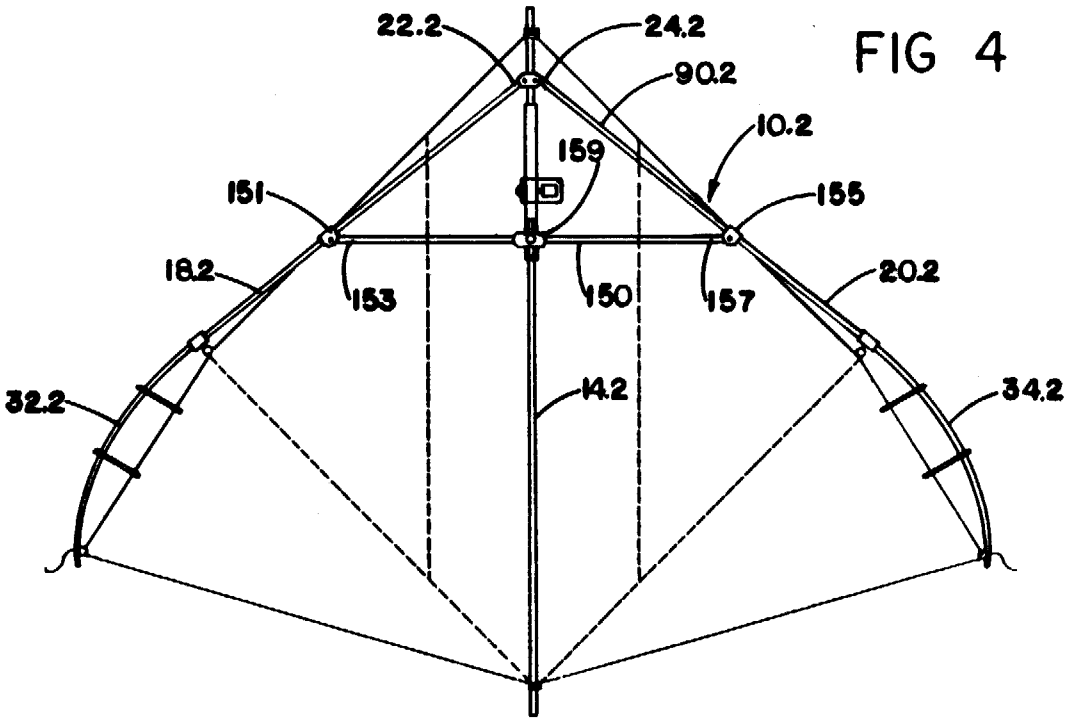
FIG. 4 is a bottom plan view of a further boom structure and sail.

FIG. 4 illustrates a further boom and sail assembly 10.2 which is generally similar to the embodiment of FIG. 2 and so equivalent parts have the same number with the additional designation "0.2". As with the embodiment of FIG. 3, the tail booms and skirt booms have been deleted, but in addition, braces 54 and 56 are deleted. In this embodiment, the struts comprise a single cross member 150 which is hingedly connected to hinge member 151 on side boom 18.2 at its first end 153 and detachably connected to fitting 155 on side boom 20.2 at its second end 157. The boom and sail assembly is folded by detaching end 157 of the cross member and loosening clamp 159 which secures the cross member to the center boom.

Figure 5:
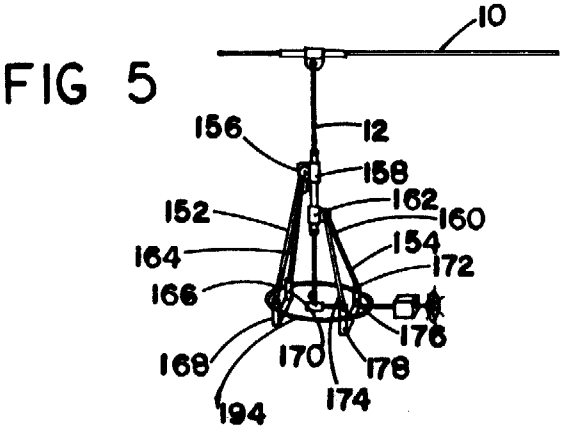
FIG. 5 is a perspective view of a mast and steering gear similar to the mast and steering gear of FIG. 1.
Figure 6:
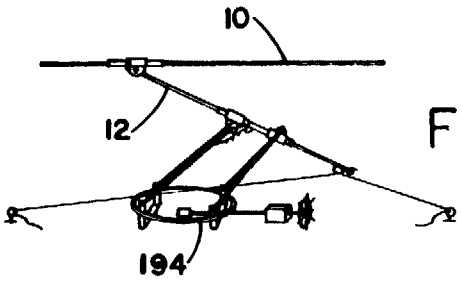
FIG. 6 is a perspective view of the mast and steering gear of FIG. 5 with the mast partly folded.

The glider sail assembly shown in FIG. 1 is also provided with means for folding the mast to a generally horizontal position. Referring to FIGS. 5 and 6, the mast 12 is supported by an inverted V-shaped fore mast support 152 and a similar aft support 154. The mast supports are suitably constructed of tubing, either glass fiber reinforced plastic or metal. The upper end 156 of the fore support 152 is hingedly connected to mast socket 158 which rotatably receives the mast. In a similar manner, the upper end 160 of the aft support 154 is hingedly connected to the mast socket 162 which also rotatably receives the mast. The mast socket and mast support accordingly provide means for rotatably mounting the mast on the yacht hull 2. The lower ends 164 and 166 of the fore supports are hingedly connected to the mounting legs 168 and 170, respectively, which may be mounted on the deck of the yacht hull. Similarly, the lower ends 172 and 174 of the aft support are hingedly connected to the mounting legs 176 and 178. Mounting leg 176 is shown in better detail in FIG. 7 with the lower end 172 of the mast support 154. Apertures are provided in the mounting plates 180 for bolting the mounting legs to the deck of the yacht.

Figure 10:
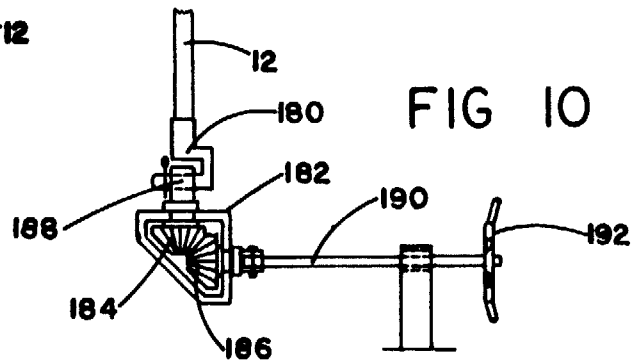
FIG. 10 is an enlarged fragmentary view of the embodiment of FIG. 1 showing the bottom of the mast and the steering gear in side elevation.

As seen in FIG. 10, there is a hook-shaped fitting 180 at the bottom end of the mast 12. A gear box 182 has a pair of bevel gears 184 and 186. An eye member 188 connected to bevel gear 184 receives hook member 180 of the mast. Bevel gear 186 is operatively connected to steering shaft 190 and wheel 192. The wheel, steering shaft, gear box, eye and hook member provide means for rotating the yacht relative to the mast 12. It should be understood in this respect that the fore end of the center boom on the boom and sail assembly is normally directed into the wind and, accordingly, the direction of travel is changed by rotating the hull relative to the mast.

Figure 7:
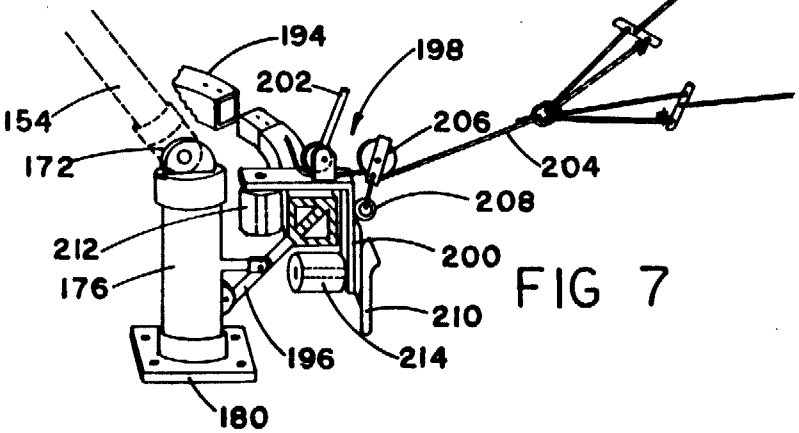
FIG. 7 is an enlarged fragmentary view of a portion of one of the mast supports, the hoop around the bottom of the mast and one of the rope runners of the embodiment shown in FIG. 1.

Since the boat hull rotates relative to the glider sail assembly, means is provided for securing ropes from the sail and booms which is rotatable relative to the hull. The assembly includes a carousel or hoop 194 which is connected to the assembly near the bottom of the mast. The mast extends upwardly from near the center of the hoop when in the operational position. As seen in FIG. 7, the hoop 194 comprises a circle of square tubing made of several sections and connected together by bolts or the like. Brackets 196 connect the hoop to the mounting legs. The ropes are connected to one of the rope runners 198 which are capable of rotating about the mast on the hoop 194. The hoop comprises a circular track for the rope runners. Each rope runner has a body portion 200 comprising a short length of angle section. A sheet stop 202 is mounted on the top of the body portion and is capable of securing one of the ropes, for example rope 204, when the handle is pivotted. A pulley 206 on the outside of the rope runner, connected to an eyelet 208, provides a guide for the rope. A rope hanger 210 is fitted below the eyelet. A vertical nylon roller 212 and a similar horizontal roller 214 are rotatably mounted on the rope runner for engagement with the inside and bottom of the hoop. The rollers make rolling contact with the hoop as the rope runner rotates about the mast.

Figure 12:
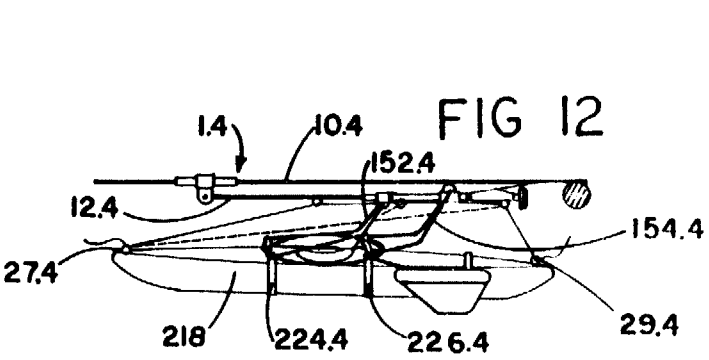
FIG. 12 is a perspective view of the embodiment of FIG. 11 fitted to a kayak and showing the mast folded.
Figure 11:
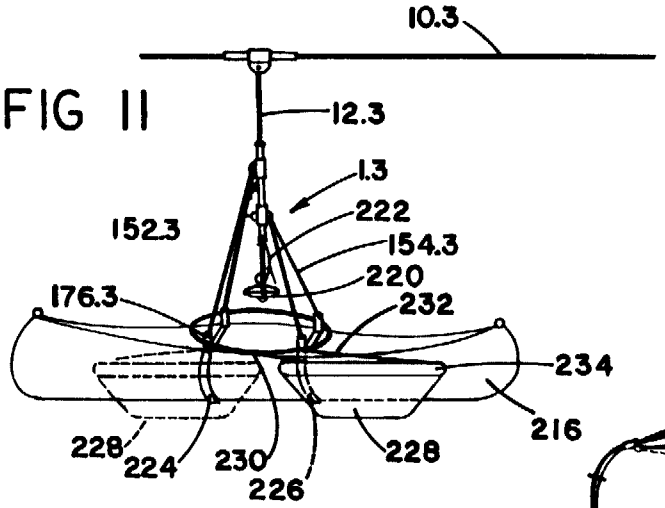
FIG. 11 is a perspective view of a glider sail assembly according to another embodiment of the invention, shown fitted to a canoe.

FIGS. 11 and 12 illustrate a slight variation of the glider sail assembly adapted for fitting to a small boat such as the canoe 216 of FIG. 11 or the kayak 218 shown in FIG. 12. The sail assembly 1.3 of FIG. 11 and sail assembly 1.4 of FIG. 12 are generally similar to that of FIGS. 1 and 2, so the same numbers are used for corresponding parts with the additional designation "0.3" in FIG. 11 and "0.4" in FIG. 12. As seen in FIG. 11, these embodiments have a handle 220 connected to the mast for rotating the boat relative to the mast instead of the steering gear and wheel of FIGS. 1 and 2. The handle 220 is wheel-shaped and is mounted on the bottom of the mast 12.3 which is spaced above the top of the canoe when the mast is erect. The sail and boom assembly 10.3 is mounted on the top of the mast. A jam lock 222 is mounted on the mast between the handle and the aft mast support 15.3 for stopping rotation of the boat relative to the mast by a lever action. The sail assembly also includes a pair of spaced-apart straps 224 and 226 for mounting the assembly on the canoe 216. The straps are secured by buckles or the like.

In order to stabilize canoe 216, sail assembly 1.3 includes a keel 228 connected to the mounting legs by a pair of swinging arms 230 and 232. A streamlined float 234 is mounted on the top of the keel. The swinging arms permit the keel to be positioned beside the canoe at either end as shown in solid lines and broken lines in FIG. 11.

The sail assembly 1.4 of FIG. 12 is similar to that of FIG. 11 and includes a sail and boom assembly 10.4, a mast 12.4 and a pair of mast supports 152.4 and 154.4. The mast is illustrated in the folded position. In this embodiment, however, the mast supports 152.4 and 154.4 are angled near the tops, unlike mast supports 152.3 and 154.3 of FIG. 11, so the folded mast is spaced-above the deck of the kayak 218.

Figure 13:
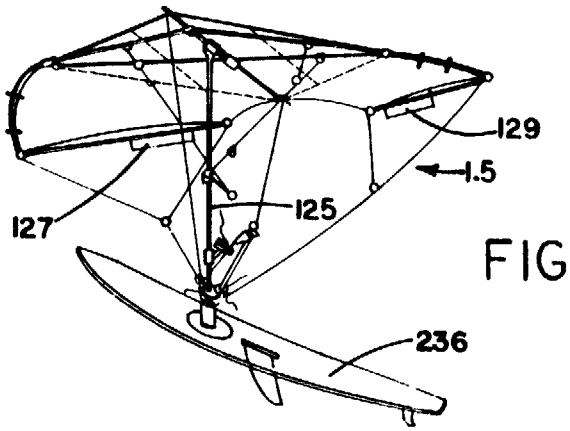
FIG. 13 is a perspective view of a glider sail assembly according to a further embodiment of the invention, shown fitted to a surf board.
Figure 14:
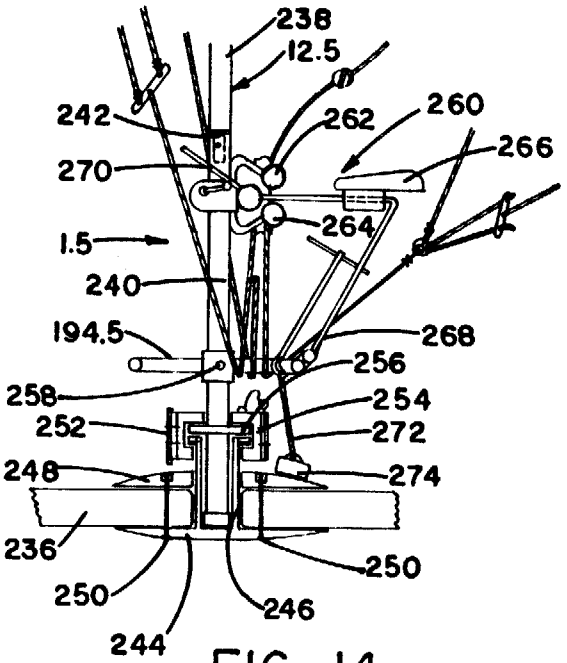
FIG. 14 is an enlarged, fragmentary view showing the bottom portion of the mast and mast mount of FIG. 13 in side elevation.

FIGS. 13 and 14 illustrate another glider sail assembly 1.5 which is generally similar to the embodiments of FIGS. 1 and 2, but is adapted for fitting on a surf board 236. In this case, however, a folding mast is not used. Instead, the mast 12.5 includes an upper portion 238 and a lower portion 240 connected by a socket joint 242 as shown in FIG. 14. The bottom end of the mast is rotatably received by mast socket 244 which extends upwardly through aperture 246 in the surf board. The mast socket is connected to the upper mounting collar 248 by a plurality of bolts 250 which extend through the surf board. Fast mounting clamps 252 and 254 secure the mast within the mast socket by means of the circular flange 256 near the bottom of the mast. A hoop 194.5 for securing the ropes is connected to the mast above the mounting clamps by a plurality of spokes 258. Rope runners are not required because hoop 194.5 rotates with the mast and the boom and sail assembly.

Glider sail assembly 1.5 is provided with a combination seat and sheet lock assembly 260. Assembly 260 includes sheet locks 262 and 264 for securing ropes from the boom and sail assembly as well as a seat 266 mounted on a bracket 268. The ropes are locked by body weight on the seat or by a manual jam lock operated by lever 270. There is another jam lock for stopping rotation of the mast comprising a rod 272 extending downwardly from hoop 194.2 and a friction block 274 mounted on the bottom of the rod. Body weight on seat 266 forces the friction block against upper mounting collar 248 and stops rotation of the mast. In this embodiment, the mast is normally positioned within the mast socket and the sail is extended to the operational position shown in FIG. 13 before being placed on top of the mast. A hole is provided in the sail so that the boom and sail assembly can be extended adjacent the surf board before being raised to the top of the mast. Tail floats 127 and 129 are connected to the skirt booms to keep the sail from sinking before being opened.

The sails of all of the embodiments are controlled by using cables or ropes as exemplified by glider sail assembly 1 of FIG. 1. A first rope 3 is used for strengthening the assembly and is connected at its two ends 5 and 7 to the side booms 18 and 20 near the struts 36 and 38. Rope 3 extends downwardly in a V-shaped arrangement and is slidably received through a guide or eyelet 9 on the hoop 194 near the bottom of the mast.

A second rope 11 extends downwardly from the fore end 16 of the center boom and is secured to the hoop 194. Similarly, a third rope 13 extends downwardly from the aft end of the center boom and is secured to the hoop. When the second and third ropes are tensioned, they are capable of adjusting the upwards angle of the center boom. Since the center boom is somewhat flexible, ropes 11 and 13 can be tensioned to bend the center boom in a bow shape and thereby provide curvature to the sail and increased lift.

The glider sail assembly is also provided with a fourth rope 15 and a fifth rope 17. The upper portion of rope 15 is bifurcated and consists of the two ropes 19 and 21 which are connected to the aft end 26 of side boom 18 and the outside end 108 of tail rod 100, respectively. Similarly, upper portions 23 and 25 of rope 17 are connected to the outer end 110 of tail rod 102 and the aft end 28 of side boom 20, respectively. When rope 15 is pulled downwardly and tensioned, it deflects the flexible portion 32 of side boom 18 downwardly along with the skirt portion 92 of sail 90. Similarly, when rope 17 is pulled downwardly, it deflects the flexible portion 34 of side boom 20 downwardly along the skirt portion 94 of the sail.

In operation, each glider sail assembly with a folding mast must first be erected and unfolded from the position illustrated in FIG. 12. Firstly, the boom and sail assembly is spread while the mast is still folded. With reference to FIG. 2, this is accomplished by applying tension to ropes 133 and 142 which causes side booms 18 and 20 to extend to the V-shaped arrangement. For convenience, as seen in FIG. 7, pulleys or guides 27 and 29 are provided at the bow and stern of the vessel for the ropes 132 and 142 so they can be controlled from a central location. The embodiment of FIG. 12 has similar guides 27.4 and 29.4.

The fore end of the center boom is directed into the wind and the center boom and sail are tilted upwards towards the fore end. The said thereby provides lift to raise the mast from the folded position shown in FIG. 12 to the unfolded, erect position shown in FIGS. 1 and 11. With proper guidance, the sail is capable of maintaining the proper orientation as the mast is raised because of the hinged connection with the top of the mast as illustrated in FIG. 8. Once the mast is erect, ropes 11 and 13 are pre-adjusted and locked in position on hoop 194.

FIGS. 16 and 17 illustrate the yacht 2 and glider sail assembly 1 with the mast 12 erect, but in the neutral position. In this state, there is no propulsive force. The fore end 16 of the boom and sail assembly 10 is pointed into the wind.

FIGS. 18 and 19 show the sail tilted back, with the fore end 16 of the center boom tilted upwardly, so the sail catches the wind. The tilting is accomplished by means of ropes 11 and 13 shown in FIG. 1 and pivotting about the hinge connection at the top of the mast as shown in FIG. 8. In smaller crafts, such as shown in FIGS. 11 to 13, the tilt of the sail can be adjusted by shifting the person's body weight. In this position, the sail provides lift, but does not provide a propulsive force.

Next, the forward one of the two ropes 15 and 17 is pulled downwardly to tilt the sail axially about the center boom. This is accomplished by deformation of the resilient insert 76 as illustrated in FIG. 9. Accordingly, the glider sail assembly provides forward propulsion when in the position shown in FIG. 22, but is unbalanced. The sail is balanced by pulling further downwardly on the forward skirt as illustrated in FIGS. 23 to 25. The downward bending of the forward skirt, in this case skirt 92, balances the system and increases the forward speed of travel. The sail then keeps the boat stable and on course relative to the force and direction of the wind. The boat rudder 6, illustrated in FIG. 1, is locked straight and is not required.

A sudden stronger wind will not cause the boat to overturn, it will merely give the sail increased lift which tends to keep the vessel upright.

The boom and sail assembly must be positioned correctly relative to the mast in the fore and aft direction. Such an adjustment is permitted by releasing handle 88 shown in FIG. 8 and sliding the shell 74 along the center boom 14. If the mast is too far forward, the sail will straighten and will not catch any wind at all. If the mast is too far back, there could be too much leverage for the wind and this could cause the boat to tip.

In order to change tack, the forward skirt is released. In other words, referring to FIG. 1, rope 15 is released from the hoop 194. With reference to FIGS. 25 and 26, the hull 2 is then rotated until the wind comes from the other side of the vessel. Once the hull is rotated enough, skirt 94 is deflected downwardly by means of rope 17, which is shown in FIGS. 1 and 2, to provide the forward propulsive force. While running with the wind, it is best if the wind is not directly from the back and both skirts are not pulled down evenly, or the boat might lose some of its stability.

With sufficient wind, the craft can be made to skip-glide as illustrated in FIG. 1. The vessel will clear the water completely and, with the hull out of the water, the craft will gradually lose momentum. The sail's forward drive and lift angle lessen and the keel will touch down into the water again until enough momentum is built up to repeat the skipping motion.

The embodiments of FIGS. 11 and 12 operate essentially in the same manner as that of FIGS. 1 and 2, but a handle, such as handle 220 in FIG. 11, is used to rotate the hull instead of the wheel and steering gear shown in FIG. 10. The embodiment of FIGS. 13 and 14 is also operated in a similar manner except that the mast does not fold and the sail is lifted to the top of the mast and secured after being extended. Floats 127 and 128 are provided to keep the sail floating before erection.

What is claimed is:

1. A glider sail assembly comprising:

a center boom with a fore end for directing into a wind;

means for mounting the center boom generally horizontally at the top of a mast and directed at an upward angle towards the fore end;

two side booms, each of the side booms having a fore end hingedly connected to the center boom near the fore end of the center boom and flexible portions near an aft end of said each side boom, the side booms being extendible to diverge away from each other in a V-shaped arrangement;

a pair of struts for holding the side booms outwardly away from the center boom in the V-shaped arrangement, each said strut having a first end connectable to the center boom and a second end connectable to one of the side booms;

a generally triangular sail securable to the booms, so the sail extends between the side booms, and having skirt portions at each side thereof adjacent the flexible portions of the side booms, the skirt portions extending downwardly when the flexible portions of the side booms are deflected downwardly, so one of the skirt portions provides a propulsive force when the center boom is directed into the wind; and first and second slide members slidably received for axial movement along the center boom, the fore ends of the side booms being hingedly connected to the first slide member, the first ends of the struts being hingedly connected to the second slide member and the second ends of the struts being hingedly connected to the side booms.

2. A glider sail assembly as claimed in claim 1, further comprising means for releasably securing the slide members at fixed positions on the center boom, so the side booms diverge in said V-shaped arrangement.

3. A glider sail assembly as claimed in claim 2, further comprising a pair of braces, each said brace having a first end hingedly connected to the center boom between the first and second slide members and a second end hingedly connected near the center of one of the struts.

4. A glider sail assembly as claimed in claim 3, wherein the means for mounting the center boom at the top of the mast is between the first ends of the braces and the first slide member.

5. A glider sail assembly comprising:

a center boom with a fore end for directing into a wind;

means for mounting the center boom generally horizontally at the top of a mast and directed at an upward angle towards the fore end, the means for mounting comprising an outer shell hingedly connectable to the top of the mast and extending about the center boom and a resilient member comprising a tubular insert between the outer shell and the center boom, the resilient member allowing lateral tilting of the sail about the center boom;

two side booms, each of the side booms having a fore end connected to the center boom near the fore end of the center boom and flexible portions near an aft end of each side boom, the side booms being extendible to diverge away from each other in a V-shaped arrangement; and a generally triangular sail securable to the booms, so the sail extends between the side booms, and having skirt portions at each side thereof adjacent the flexible portions of the side booms, the skirt portions extending downwardly when the flexible portions of the side booms are deflected downwardly, so one of the skirt portions provides a propulsive force when the center boom is directed into the wind.

6. A glider sail assembly as claimed in claim 5, further comprising a section of square tubular reinforcement on the center boom, the outer shell and insert fitting about the reinforcement.

7. A glider sail assembly as claimed in claim 6, the outer shell and insert being axially slidable along the reinforcement.

8. A glider sail assembly as claimed in claim 7, wherein the outer shell has a longitudinal slit below the insert and a pair of lugs to each side of the slit, the top of the mast being received between the lugs, the assembly further comprising a pin for extending through apertures in the lugs and the mast and a cam action lever pivotally connected to one end of the pin, the pin pivotally connecting the mast to the center boom and the lever and shell providing a clamping action, when the lever is pivotted, to releasably secure the means for mounting at a fixed axial position along the reinforcement.

9. A glider sail assembly comprising:

a center boom with an aft end and a fore end for directing into a wind;

means for mounting the center boom generally horizontally at the top of a mast and directed at an upward angle towards the fore end;

two side booms, each of the side booms having a fore end hingedly connected to the center boom near the fore end of the center boom and flexible portions near an aft end of said each side boom, the side booms being extendible to diverge away from each other in a V-shaped arrangement;

a pair of struts for holding the side booms outwardly away from the center boom in the V-shaped arrangement, each said strut having a first end connectable to the center boom and a second end connectable to one of the side booms;

a generally triangular sail securable to the booms, so the sail extends between the side booms, and having skirt portions at each side thereof adjacent the flexible portions of the side booms, the skirt portions extending downwardly when the flexible portions of the side booms are deflected downwardly, so one of the skirt portions provides a propulsive force when the center boom is directed into the wind;

first and second slide members slidably received for axial movement along the center boom, the fore ends of the side booms being hingedly connected to the first slide member, the first ends of the struts being hingedly connected to the second slide member and the second ends of the struts being hingedly connected to the side booms;

means for releasably securing the slide members at fixed positions on the center boom, so the side booms diverge in said V-shaped arrangement;

a pair of braces, each said brace having a first end hingedly connected to the center boom between the first and second slide members and a second end hingedly connected near the center of one of the struts;

a third slide member slidably received on the center boom near the aft end;

a pair of tail rods, each of the tail rods extending between the center boom and one of the skirt portions of the sail near the aft end of the center boom, having an inner end hingedly connected to the third slide member and an outer end connectable to the sail adjacent the one skirt portion;

a pair of skirt booms, each of the skirt booms having an outer end connected to the aft end of one of the side booms and an inner end securable adjacent to the outer end of one of the tail rods; and means for releasably securing the third slide member at a fixed position near the aft end of the center boom.

10. A glider sail assembly as claimed in claim 9, wherein the flexible portions of the side booms each has a fore end, the assembly further comprising a pair of cables, each said cable extending between the fore ends of one of the flexible portions and the outer end of one of the tail rods, the inner ends of the skirt booms being slidably connected to the cables, each of the skirt portions being between the flexible portion of one of the side booms, one of the skirt booms and one of the cables, when the assembly is extended.

11. A glider sail assembly as claimed in claim 10, wherein the assembly is foldable from an extended position, where the side booms are in the V-shaped arrangement, by releasing the means securing the first, second and third slide members at the fixed positions on the center boom, and hingedly moving the side booms towards the center boom, moving the first and third slide members toward the fore end of the center boom, moving the second slide member towards the aft end of the center boom and sliding the inner ends of the skirt booms along the cables towards the forward ends of the flexible portions of the side booms.

12. A glider sail assembly comprising:

a mast, means for rotatably mounting the mast on a vessel or vehicle for axial rotation and means for rotating the vessel or vehicle relative to the mast;

a center boom with a fore end for directing into a wind; means for mounting the center boom generally horizontally at the top of a mast and directed at an upward angle towards the fore end;

two side booms, each of the said booms having a fore end connected to the center boom near the fore end of the center boom and flexible portions near an aft end of said each side boom, the side booms being extendible to diverge away from each other in a V-shaped arrangement; and a generally triangular sail securable to the booms, so the sail extends between the side booms, and having skirt portions at each side thereof adjacent the flexible portions of the side booms, the skirt portions extending downwardly when the flexible portions of the side booms are deflected downwardly, so one of the skirt portions provides a propulsive force when the center boom is directed into the wind; and means for folding the mast to a generally horizontal position comprising fore and aft hinged mast supports, each said mast support having a lower end with means for hingedly connecting the support to the vessel or vehicle and having an upper end hingedly connected to the mast, the mast supports being inverted V-shaped, the upper end of said fore support being higher on the mast than the upper end of the aft support, so the top of the mast folds forwardly when the supports are folded rearwardly on the vessel or vehicle.

13. A glider sail assembly as claimed in claim 12, the upper ends of the supports being connected to collars for rotatably receiving the mast.

14. A glider sail assembly comprising:

a flexible center boom with a fore end for directing into a wind and an aft end;

means for mounting the center bore generally horizontally at the top of a mast and directed at an upward angle towards the fore end;

two side booms, each of the side booms having a fore end hingedly connected to the center boom near the fore end of the center boom and flexible portions near an aft end of said each side boom, the side booms being extendible to diverge away from each other in a V-shaped arrangement;

a pair of struts for holding the side booms outwardly away from the center boom in the V-shaped arrangement, each said strut having a first end connectable to the center boom and a second end connectable to one of the side booms;

a generally triangular sail securable to the booms, so the sail extends between the side booms, and having skirt portions at each side thereof adjacent the flexible portions of the side booms, the skirt portions extending downwardly when the flexible portions of the side booms are deflected downwardly, so one of the skirt portions provides a propulsive force when the center boom is directed into the wind; and a first cable for strengthening the assembly, the first cable being connected at each end to one of the side booms near the struts and being extendable downwardly in a V-shaped arrangement and slidably received by a guide means near the bottom of the mast, second and third cables extending downwardly from the fore and aft ends of the center boom to be secured near the bottom of the mast, the second and third cables being tensioned to adjust the upwards angle of the center boom and to bend the center boom in a bow shape and thereby providing increased lift for the sail, and fourth and fifth cables connected to the aft ends of the side booms, one of said fourth and fifth cables being tensioned to deflect the flexible portion of one of the side booms downwardly with one of the skirt portions of the sail to provide said propulsive force.

* * * * *